United States Patent [19]

Dickie

[11] Patent Number: 4,927,373

[45] Date of Patent: May 22, 1990

[54] ELECTRICAL SAFETY RECEPTACLE ASSEMBLY

[75] Inventor: Robert G. Dickie, Newmarket, Canada

[73] Assignee: Paige Manufacturing Company, Inc., Newmarket, Canada

[21] Appl. No.: 427,073

[22] Filed: Oct. 26, 1989

[51] Int. Cl.[5] ..... H01R 29/00

[52] U.S. Cl. ..... 439/188; 200/51.09

[58] Field of Search ..... 439/188, 511, 512; 200/51.09

[56] References Cited

U.S. PATENT DOCUMENTS 3,699,285 10/1972 Leatherman ..... 200/51.09

3,982,084 9/1976 Cooperstein ..... 200/51.09

FOREIGN PATENT DOCUMENTS 1304161 8/1962 France ..... 200/51.09

*Primary Examiner*—Paula A. Bradley

[57] ABSTRACT

A contact assembly for alternating current electrical receptacles is disclosed in which electricity is not applied to the pins of a mating electrical plug until the plug is inserted substantially entirely into the receptacle assembly. The wiper contacts which engage the pin when it is pushed into the receptacle are initially not connected to the electrical source. When the tip of the pins engage the bottom of the receptacle housing, it engages a separate contact assembly which makes electrical connection to the electrical source only after the pins are inserted almost entirely into the receptacle. The exposed portion of the pins of the electrical plug are therefore not energized until the plug is almost fully inserted, thus preventing inadvertent touching of the exposed pins and the resultant electrical shock.

9 Claims, 2 Drawing Sheets

ELECTRICAL SAFETY RECEPTACLE ASSEMBLY

TECHNICAL FIELD

This invention relates to alternating current electrical receptacles and, more particularly, to receptacles having reduced risk of accidental shock.

BACKGROUND OF THE INVENTION

In order to provide adequate electrical contact between common household electrical plugs and the corresponding electrical receptacles, it has been common to provide a sliding contact between the pins of the electrical plug and a substantial length of the mating contacts in the receptacle. This sliding contact takes place at an extended length of a central portion of the receptacle contacts and the pins of the plug. In order to assure an adequate, low-resistance contact, the receptacle contacts are generally bifurcated so as to grasp and hold the pin between two contact elements arranged to exert a closing force on the pin. While such prior art receptacles have normally provided adequate electrical contact with the pins of the mating plug, such contact deteriorates under environmental conditions where the wiping surface of the bifurcated contacts may become coated with nonconductive material. More importantly, such prior art electrical receptacles initiate electrical contact while the pins are inserted into the receptacle only a small portion of their entire length. It is therefore possible to inadvertently touch an exposed portion of the plug pins and receive an electrical shock. This is a particular danger for small children or elderly persons who have difficulty in removing the plug and tend to insert their fingers under the plug to assist in removal. Small children also tend to play with electrical plugs, thereby increasing the danger.

It would be an improvement from a safety viewpoint to permit electrical contact inside of an electrical receptacle only after the pins have been inserted substantially all of the way into the receptacle, leaving very little of the pin length exposed. Unfortunately, the tips of the pins tend to vary in size and position to such an extent that a solid electrical contact cannot be guaranteed if only the tips of the pins are used to make contact. Worse, such tip-only contacts tend to be intermittent, damaging the electrical appliances connected to the plug.

SUMMARY OF THE INVENTION

In accordance with the illustrative embodiment of the present invention, the danger of exposed electrical pins is reduced or eliminated by using the tips of an electrical plug to operate entirely separate electrical contacts which only then allow electricity to flow through the bifurcated contacts and into the pins of the electrical plug. Such separate contacts are arranged to close only when the pin is essentially all of the way into the receptacle and hence to energize the the wiper contacts and the pins only when the plug is almost fully inserted. More particularly, the bifurcated contacts of the receptacle are not connected directly to the electrical conductors carrying electricity. Instead, the contacts include at the innermost end at least one normally open contact which is closed by movement of the tip of the pin into contact with this innermost end of the contacts.

The major advantage of the late-connecting safety receptacle of the present invention is the reduction or elimination of exposed, live contact pins during the insertion and removal operations when the users hand are in contact with the electrical plug. In addition, the bifurcated wiper contacts provide a natural way to engage and operate a pair of oppositely disposed positive closure contacts which do not rely on a wiping action to provide contact. Such positive closure contacts tend to produce less sparking at initial contact engagement and final contact disengagement, thereby reducing pitting and wear on the contact surfaces.

The late-operating safety contacts of the present invention can be used in portable electrical extension cords as well as in fixed wall receptacles. Indeed, the danger of exposed electrical pins is greater for extension cords where two hands are typically used to insert and remove the plug from the receptacle.

In a preferred embodiment, the positive closure contacts are formed with a cup-shaped stationary contact permitting dual, oppositely disposed contacts to engage the inner surface of the same cup, thereby to provide two separate and distinct electrical contact paths through the same cup contact. Moreover, the cup-shaped contacts allow easy manufacture of the safety receptacle by forming natural holders for dummy contact assemblies to be inserted during injection molding, later to be removed and replaced with operating contact assemblies.

BRIEF DESCRIPTION OF THE DRAWINGS

A complete understanding of the present invention may be gained by considering the following detailed description in conjunction with the accompanying drawings, in which.

To facilitate reader understanding, identical reference numerals are used to designate elements common to the figures.

DETAILED DESCRIPTION

Figure 1:
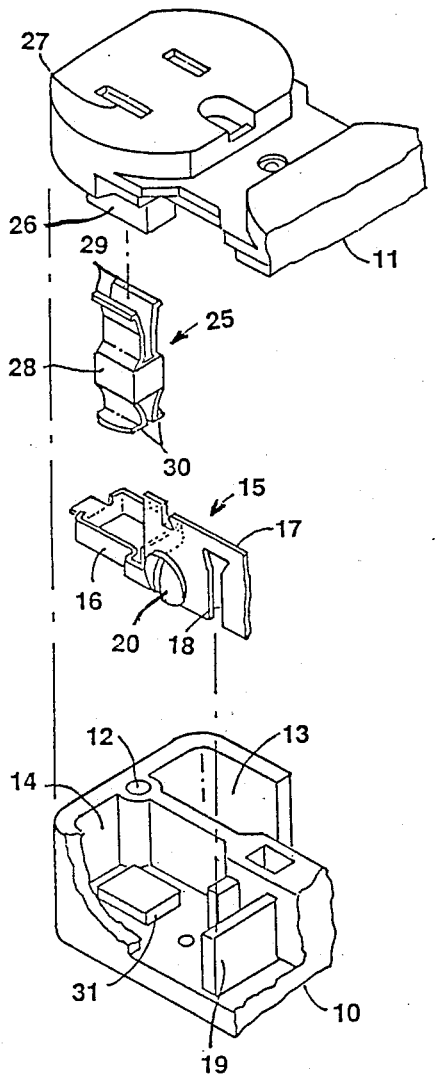
FIG. 1 shows an exploded partial perspective view of an electrical wall receptacle assembly having late-closing safety contacts in accordance with the present invention.

Referring more specifically to FIG. 1, there is shown an exploded perspective view of a portion of an electrical alternating current receptacle utilizing the late-closing safety contacts of the present invention. More particularly, the receptacle of FIG. 1 comprises a body portion 10 and a cover portion 11 designed to mate together and registered by use of a guide pin (not shown) on the underside of cover 11 which fits into guide hole 12 in body portion 10. Body portion 10 defines a symmetrical pair of cavities 13 and 14 for receiving a fixed contact assembly 15 made of conductive material and including a four-sided open box 16 and a conductive tab 17. When assembled, box 16 fits over raised land 31 to insure proper positioning of fixed contact assembly 15 when the receptacle is fully assembled. Tab 17 includes a slot 18 which engages a interior wall 19 in body portion 10 and a screw 20 for connecting an electrical wire to tab 17. Tab 17 is shown only partially; in fact, a mirror image contact assembly extends in a forward direction into a mirror image cavity in body 10 which forms the fixed contact for another electrical receptacle in the common household duplex receptacle.

A double-ended, movable bifurcated contact element 25 is arranged to fit into a recess 26 on the underside of cover 11 which recess communicates with a pin opening 27 in the face of cover 11. Contact element 25 comprises a box-shaped central portion 28 with two pairs of oppositely disposed bifurcated contact elements 29 and 30. Contact elements 29 are arranged to engage an electrical pin or blade on a plug inserted into receptacle cover 11. Contact elements 30 are arranged to electrically contact the inner surfaces of box 16 on fixed contact assembly 15 when the two bifurcated contact elements 30 are separated by the insertion of an electrical pin or blade into the pin slot 27. Since bifurcated contacts 30 are located on the remote end of contact element 25 from slot 27, the electrical pin or blade does not engage contact elements 30 until the pin or blade is inserted almost all of the way into slot 27. This operation can be better seen in FIGS. 2 and 3, to be described below.

It is to be noted that a fixed contact assembly similar to contact assembly 15 is located in each of four cavities defined within receptacle body portion 10. Similarly, a movable contact assembly similar to contact assembly 25 is likewise located in each of four recesses similar to recess 26 on the underside of cover portion 11. Each set of fixed and movable contacts is paired with another set of fixed and movable contacts to form a dual pin receptacle for receiving the two pins or blades of a standard alternating current plug. As is standard for electrical wall outlets, two such receptacles are fabricated together into a single duplex receptacle. Only one set of contacts are shown in FIG. 1 for simplicity.

Figure 2:
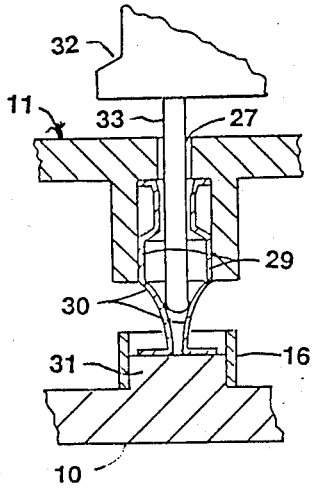
FIG. 2 shows a cross-sectional view of the contact mechanism of the safety contacts of FIG. 1 in an open position.

Turning then to FIG. 2, there is shown a partial cross-sectional view of the receptacle of FIG. 1 showing the assembled contacts. A partial view of a standard electrical plug 32 is also shown having a pin 33 which is partially inserted into slot 27 of receptacle cover portion 11. As can be seen in FIG. 2, the tip of pin 33 is just initiating engagement with bifurcated contacts 30, and the ends of contacts 30 have not yet engaged the fixed contacts 16. Since the fixed contacts 16 are the electrically energized contacts (due to the electrical connection by way of screw 20), no electricity has yet been applied to contacts 30, contacts 29 and hence to pin 33. Note that the pin 33 is therefore not energized at this time and hence cannot inadvertently apply a shock to the user who inserts a finger or other conductive tool under the plug 32 while inserting or removing plug 32.

Figure 3:
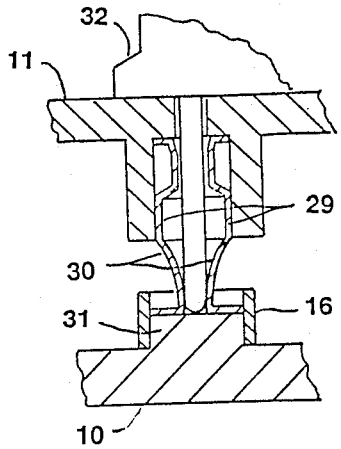
FIG. 3 shows a cross-sectional view of the contact mechanism of the safety contacts of FIG. 1 in a closed position.
Figure 5:
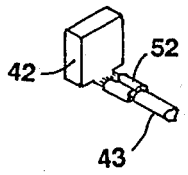
FIG. 5 shows a perspective view of the cup-shaped fixed contacts of the safety contact assembly of FIG. 4.

In FIG. 3 there is shown a partial cross-section view of the receptacle of FIG. 1 showing the assembled contacts and the plug 32 fully inserted into slot 27. It will be noted that the bifurcated contacts 30 are fully separated by the insertion of pin 33 therebetween, and have engaged the inner surfaces of box 16 to provide electrical contact and thereby energize the pin 33. The bifurcated contacts 29 serve as further contact areas for electrical connection with pin 33 while, at the same time, providing frictional resistance to the withdrawal of plug 32 from the electrical receptacle. This frictional resistance insures that the plug 32 will not inadvertently be removed from the receptacle 10-11 by minor forces exerted on the plug 32 or the electrical wire connected thereto.

FIGS. 1, 2 and 3 show the application of the late-connecting safety contacts to standard electrical duplex wall outlets. Such safety contacts can be applied to any other form of electrical plug and socket connection by modifications obvious to those skilled in the art. As an example, FIGS. 4, 5, 6 and 7 show the application of the present invention to the receptacle end of a standard extension cord.

Figure 4:
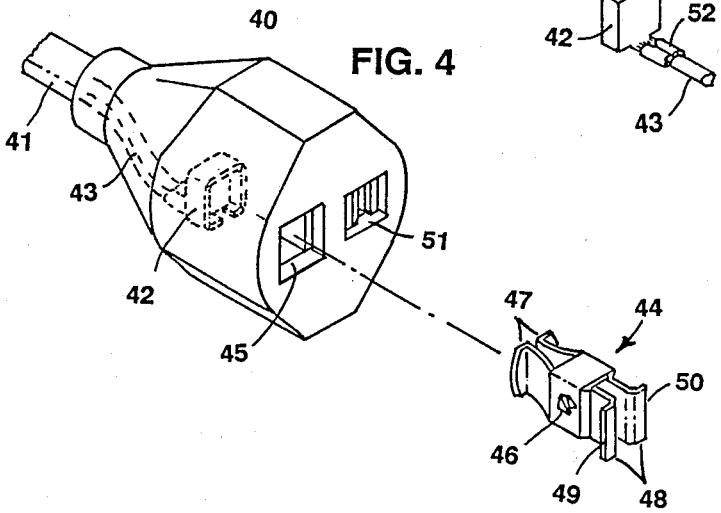
FIG. 4 shows an exploded view of an extension cord receptacle assembly including late-closing safety contacts in accordance with the present invention.

FIG. 4 shows a perspective exploded partial view of the receptacle end 40 of a standard extension cord 41. A box-shaped fixed contact 42 is embedded in the receptacle end 40 of the extension cord 41. Fixed contact 42 has a closed bottom and an open top. An electrical wire 43 from cord 41 is connected to contact 42 by crimping or soldering or both. A movable contact assembly 44 is adapted to be inserted into a recessed opening 45 in receptacle end 40 and held in place by spurs 46 on each side of the central box portion of contact assembly 44. Like contact assembly 25 in FIG. 1, contact assembly 44 in FIG. 4 has two pairs of oppositely disposed bifurcated contact elements 47 and 48. Bifurcated contact elements 47 are arranged to fit into fixed contact box 42 without touching the bottom of box 42. Bifurcated contact elements 48 have flanges 49 and 50 arranged to engage the edges of the recessed opening 45 in receptacle 40, as can be seen at the other opening 51 of receptacle 40. The fixed contact 42 can be better seen in FIG. 5 which is a perspective view of the contact 42 as seen from the rear with the wire 43 connected to the contact 42 by a crimp 52.

The late-closing safety receptacle of the present invention can be fabricated in an extension cord such as that shown in FIG. 4 by standard plastic injection overmolding techniques. The wires are first connected to the two fixed contacts such as contact 42 by crimping or soldering or both. These contacts are then inserted on the end of two posts defining the volume required for the movable contact assemblies such as assembly 44. The contacts, with the posts inserted, are then place inside the injection mold and a nonconductive thermoplastic material injected into the mold under pressure. Once the thermo-plastic material is semiset, the posts are retracted and the movable bifurcated contact assemblies 44 inserted into the void left by the posts. The barbs 46 are locked into the setting thermoplastic material, thus preventing extraction, while the flanges 49 and 50 limit the inward positioning of the contacts 44. The late-closing safety contacts of the present invention therefore add very little to the cost of manufacturing electrical outlets, receptacles or extension cords.

Figure 6:
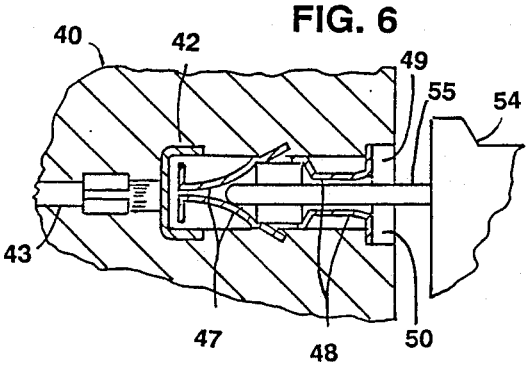
FIG. 6 shows a cross-sectional view of the safety contact assembly of FIG. 4 in the open position.
Figure 7:
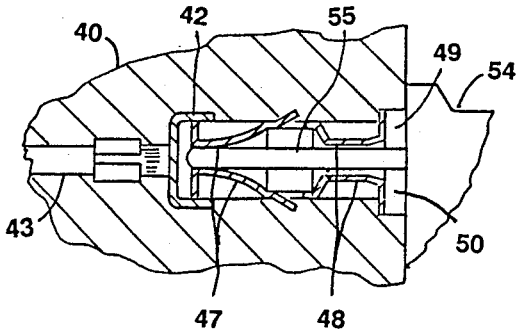
FIG. 7 shows a cross-sectional view of the safety contact assembly of FIG. 4 in the closed position.

FIG. 6 shows a partial cross-section view of the receptacle end 40 of extension cord 41 showing a partial view of a plug 54 having an electrical pin or blade 55 connected thereto. In FIG. 6, pin or blade 55 is show as just starting to engage bifurcated contacts 47 which are not yet separated enough to engage the inside edges of box 42. It is to be noted that, at this position, where the plug 54 is almost entirely inserted into the receptacle 40, the contact assembly 44 is not yet electrically energized and hence pin 55 does not yet carry electricity. It is therefore impossible to get an electrical shock from the exposed portions of pin 55 even if fingers or other tools are inserted under the plug 54.

In FIG. there is shown a partial cross-section view of the receptacle end 40 of extension cord 41 with the plug 54 fully inserted into the receptacle. It will be noted that, in this position, the bifurcated contacts 47 are fully separated and engage the inner surface of the fixed contact box 42 to complete the electrical connection through the extension cord 41 and receptacle 40 to plug 54.

It will be noted that the safety receptacle in accordance with the present invention is entirely passive in that absolutely no action is required by the user in order to have full advantage of the safety features. It is therefore extremely effective for infants, small children and the elderly who are not apt to take the necessary actions required to activate active safety systems. It will also be noted that the improved receptacle of the present invention provides full wiping contact of the pin blades to the contact surface at the center of the blades as required by Underwriters'Laboratory standards. Finally, the near closure of the outer bifurcated contact elements presents a partially closed entrance to the receptacle, thus rendering it more difficult to insert foreign objects such as nails into the receptacle. These outer contacts are not, of course, live and hence present no danger of shock in and of themselves.

One advantage of the box-shaped fixed contacts is the ability to provide two balanced electrical contact points. This eliminates intermittent connections which might otherwise result if the plug is forced from side to side. Both the wall receptacle and the extension cord receptacle can be manufactured in the same size and with the same features as existing receptacles, using the same materials and the same automated equipment, requiring only minor changes in the sub-assemblies and procedures to accommodate the late-closing contacts of the present invention. Note that the width of the bifurcated contact assemblies can be varied to suit the space available and the shape of the outer bifurcated contacts adjusted to increase or decrease the contact pressure on the inserted pins.

It should also be clear to those skilled in the art that further embodiments of the present invention may be made by those skilled in the art without departing from the teachings of the present invention.

What is claimed is:

1. An electrical receptacle comprising
- a receptacle housing,
- at least one pair of normally-open contacts disposed within said housing, and
- means, responsive to the insertion of an electrical pin into said housing, for closing said normally-open contacts only after said pin is inserted a substantial distance into said housing,
- said means for closing said normally-open contacts comprising
  - fixed contacts,
  - bifurcated movable elements having contacts at the ends thereof,
  - said bifurcated movable elements being responsive to the insertion of said electrical pin therebetween to move said contacts into electrical connection with said fixed contacts.

2. The electrical receptacle according to claim 1 wherein said fixed contacts comprise
- a conductive box having contacting surfaces on the inner surface of said box.

3. The electrical receptacle according to claim 1 further comprising
- means for mounting said receptacle inside an electrical connection box.

4. The electrical receptacle according to claim 1 further comprising
- means for mounting said receptacle at one end of an electrical extension cord.

5. A female electrical receptacle for receiving the pins of an electrical plug, said receptacle comprising
- at least one pair of bifurcated electrical blades disposed to receive and make electrical contact with one of said pins,
- separate contacting means, operated by the insertion of said pin into said receptacle, for energizing said electrical blades.

6. The electrical receptacle according to claim 5 further comprising
- means for mounting said receptacle in a wall outlet.

7. The electrical receptacle according to claim 5 further comprising
- means for attaching said receptacle to an electrical extension cord.

8. The electrical receptacle according to claim 5 wherein said separate contacting means comprises
- movable electrical contacts attached to the ends of said bifurcated blades,
- fixed contacts disposed in close proximity to, but not touching, said electrical contacts, and
- means responsive to the insertion of one of said pins into said receptacle for urging said movable contacts against said fixed contacts.

9. The electrical receptacle according to claim 8 wherein said fixed contacts comprise
- a box-shaped element of conductive material connected to a source of electricity.

* * * * *